US005415221A

United States Patent [19]

Zakryk

[11] Patent Number: 5,415,221

[45] Date of Patent: May 16, 1995

[54] AUTO SWITCHING SWIMMING POOL/SPA HEATER SYSTEM

[76] Inventor: John M. Zakryk, 1300 S. Andrews Ave., Pompano Beach, Fla. 33069

[21] Appl. No.: 164,469

[22] Filed: Dec. 9, 1993

[51] Int. Cl.[6] ..... E04H 4/12

[52] U.S. Cl. ..... 165/38; 165/47; 165/108; 4/489; 4/493; 4/509

[58] Field of Search ..... 165/38, 47, 108; 4/489, 4/493, 509

[56] References Cited

U.S. PATENT DOCUMENTS

| | | | |
|---|---|---|---|
| 1,796,291 | 3/1931 | Lippincott | 4/489 |
| 3,623,165 | 11/1971 | Whittell, Jr. | 4/489 |
| 3,781,925 | 1/1974 | Curtis et al. | 4/493 |
| 3,801,992 | 4/1974 | Sable | 4/509 |
| 3,837,016 | 9/1974 | Schindler et al. | 4/489 |
| 3,988,787 | 11/1976 | Colee | 4/494 |
| 4,185,333 | 1/1980 | Ortega | 4/489 |
| 4,371,003 | 2/1983 | Goguen | 4/489 |
| 4,621,613 | 11/1986 | Krumhansl | 4/493 |
| 5,278,455 | 1/1994 | Hamos | 4/493 |
| 5,287,567 | 2/1994 | Eash et al. | 4/493 |

*Primary Examiner*—John K. Ford

*Attorney, Agent, or Firm*—Malloy & Malloy

[57] ABSTRACT

An auto switching swimming pool/spa heater system, to be utilized with a pool and a spa, including a pool pump, a spa pump, and a single heater unit, the heater unit adapted to receive water flow from the pool pump and spa pump into an internal pool/spa flow control apparatus which directs water received from both the pool pump and the spa pump through a coiled heat exchange conduit of the heater unit, for subsequent heating thereof. The flow control apparatus including a bypass conduit with a spring loaded flow regulator valve therein adapted to enable water to bypass the heat exchange conduit upon an increase pressure build up of water directed towards the heat exchange conduit, water exiting the bypass conduit and water exiting the heat exchange conduit being directed through a single water outlet of the heater unit into the spa where heated water overflow passes from the spa into the pool, accordingly heating the pool. Further, the heater system includes a flow switch adapted to be triggered by water exiting the spa pump, the flow switch automatically shutting off the pool pump while spa water is being pumped therethrough.

9 Claims, 2 Drawing Sheets

AUTO SWITCHING SWIMMING POOL/SPA HEATER SYSTEM

BACKGROUND OF THE INVENTION

1. Field of the Invention

The present invention relates to an auto switching swimming pool/spa heater system wherein only a single heater unit need be used and switching on of the spa automatically results in shutting down the pool pump.

2. Description of the Related Art

Most pools and spas, when heating is necessitated for the pool, utilize an independent heater for the spa and an independent heater for the swimming pool. This, however, is significantly inefficient because it necessitates the purchase of an additional heater unit with its own independent controls. Due to the independent functioning of each of the heater units, both heaters may be on simultaneously when only one is needed. For example, the pool heater is generally set on its timer schedule and left to run on its own, but when a user desires to utilize the spa, they must independently turn on the spa. Unless the user specifically shuts down the pool heater and pump, both heaters and pumps will unnecessarily run. In an attempt to increase efficiency, some known systems utilize a single heater unit to work for both the spa and the swimming pool. These single heater systems are effective to eliminate unwanted running time of a second heater unit, but are often complicated to implement. More particularly, a user must usually adjust the number of valves regulating the water to be directed to the heater. Further, the user must manually stop the pool pump itself when not needed or risk serious damage to the pool pump if it remains on and the system flow control valves are set for spa use. Accordingly, these systems, even if they include a remote spa switch, will require a user to leave the pool area and go to the pool pump and filter area, often located amidst bushes or trees in a concealed area, to adjust the valves and turn off the pool pump which is functioning unnecessarily.

It would therefore be highly beneficial to have an automatic switching swimming pool/spa heater system which utilizes only a single heater thereby making it considerably more efficient and cost effective than two heater systems, and is configured such that a single spa switch will automatically turn on the spa pump, shut down the swimming pool pump such that it is not working unnecessarily and provide proper water flow without adjusting numerous valves. The system of the present invention is specifically adapted to provide for the efficient use and effective and facilitated switch over from spa use to swimming pool use utilizing solely a spa switch.

SUMMARY OF THE INVENTION

The present invention is directed towards an auto switching swimming pool/spa heater system to be utilized with a pool and a spa combination. The pool and the spa each being of the type including a drain therein and being disposed with relation to one another such that excess water in the spa overflows into the pool. More particularly, the auto switching swimming pool/spa heater system of the present invention includes a single heater unit. The single heater unit includes a spa water intake, a pool water intake, a water outlet, a coiled heat exchange conduit, and an internal pool/spa flow control apparatus. The coiled heating exchange conduit is disposed within the heater unit so as to facilitate the passage of water through the heater unit, the water being heated during its passage therethrough.

Additionally, the system includes a pool pump and a pool drainage conduit. The pool drainage conduit is disposed between the pool pump and the pool drain such that the pool pump will draw water from the pool through the pool drain and the pool drainage conduit into the pool pump. Extending from the pool pump and disposed in fluid communication therewith is a pool pump outlet conduit. The pool pump outlet conduit directs water exiting the pool pump to a pool/heater junction. The pool/heater junction, which is connected to the pool pump outlet conduit at its pump inlet splits into a pool outlet and a heater outlet. Further, the pool/heater junction includes a flow control valve adapted to regulate the proportion of water exiting the pool/heater junction through the pool outlet and the heater outlet. A pool inlet conduit is connected to the pool outlet of the pool/heater junction and thereby directs water exiting the pool/heater junction back into the pool. Similarly, a heater inlet conduit is connected to the heater outlet of the pool/heater junction. The heater outlet is adapted to direct the pool water into the pool water intake of the heater unit.

Further included as part of the system is a spa pump. Utilizing a spa drainage conduit connected in fluid flow communication between the spa pump and the spa drain, the spa pump draws water from the spa through the drain and the spa drainage conduit. A spa pump outlet conduit, connected to the spa pump, directs water exiting the spa pump to the spa water intake of the heater unit. Further included within the spa pump outlet conduit is a flow switch. The flow switch is adapted to shut off the pool pump upon the passage of water through the spa pump outlet conduits.

Within the heater unit, both the spa water intake and the pool water intake include a one-way valve therein such that water can flow only into the heater unit through the respective intakes. The spa water intake and pool water intake direct water into the internal pool/spa flow control apparatus within the heater unit. Specifically, the flow control apparatus includes a heater flow junction and a bypass conduit. The heater flow junction includes a single water inlet to receive water from the spa water intake and the pool water intake, and includes two outlets, namely, a bypass outlet and a heat exchange outlet. Specifically, the bypass outlet directs water into the bypass conduit and the heat exchange outlet directs water into the heat exchange conduit for subsequent heating of the water. Disposed within the bypass conduit is a spring loaded flow regulator valve. As water is directed into the heater flow junction, the water flow is directed out solely through the heat exchange outlet. Water flow pressure can, however, build up during use as no water can exit through the one-way valves within the spa water intake and the pool water intake. As a result, when water flow pressure builds up sufficiently, the spring loaded flow regulator valve within the bypass conduit will open enabling some of the water to bypass the heat exchange conduit and be directed immediately to the water outlet. Water exiting both the bypass conduit and the heat exchange conduit pass through the water outlet of the heater unit so as to exit the heater unit. Connected to the water outlet of the heater unit is a spa water return conduit. The spa water return conduit directs all water exiting the heater to the spa thereby filling the spa. If the spa pump has been turned on so as to be the only pump operating, water merely circulates through the spa maintaining its substantially constant level. If, however, the pool pump is on, the water drawn from the swimming pool directly is sent into the spa upon exiting the heater, thereby resulting in the water level in the spa to increase until the heated spa water flows out of the spa and into the pool.

It is a primary object of the present invention to provide a swimming pool/spa heater system which will enable a single heater unit to be used efficiently and effectively without significant adaptation whenever pool to spa conversion is necessitated.

Still another object of the present invention is to provide a pool/spa heater system which can be easily switched from pool use to spa use merely by turning on the spa pump.

A further object of the present invention is to provide a pool/spa heater system which will not unnecessarily allow the pool pump to function during spa use.

Yet another object of the present invention is to provide a pool/spa heater system which does not require frequent and complicated valve adjustments during pool to spa conversion and use unless expressly desired.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
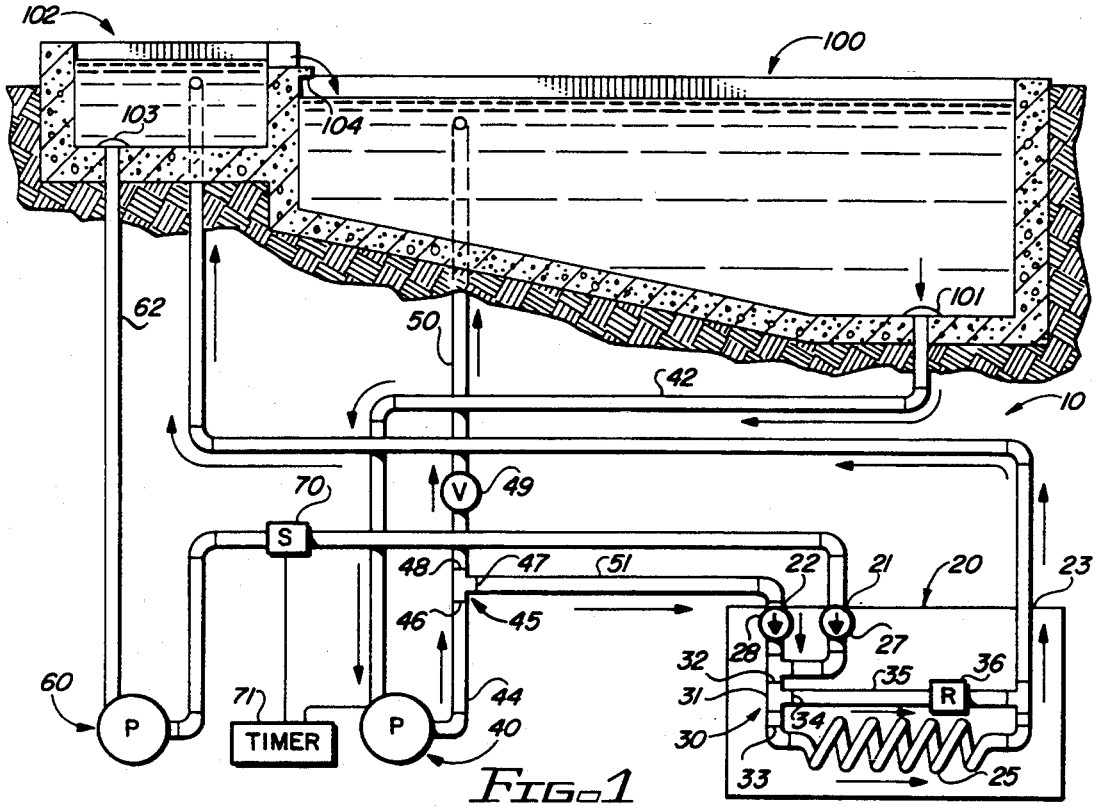
FIG. 1 is a schematic of the pool/spa heater system during pool only heating use.

Shown throughout FIGS. 1–4, the present invention is directed towards an auto switching swimming pool/spa heater system, generally indicated as 10. The heater system 10 is adapted to be used with a swimming pool 100 and spa 102 combination. The combination is of the type wherein the spa 102 overhangs the pool 100 at a lip 104, the lip 104 being disposed to enable excess water within the spa 102 to overflow into the pool 100. Further, the pool 100 and spa 102 each include a respective drain 101 and 103 wherethrough a majority of the water exiting the pool passes. Most swimming pools 100 or spas 102 include such main drains 101 and 103 in the bottom surface thereof to facilitate the extraction of the water for filtration and heating. The heater system 10 includes a single heater unit 20 to be utilized to heat both the pool 100 and spa 102, thereby maximizing the efficiency of the system.

Figure 4:
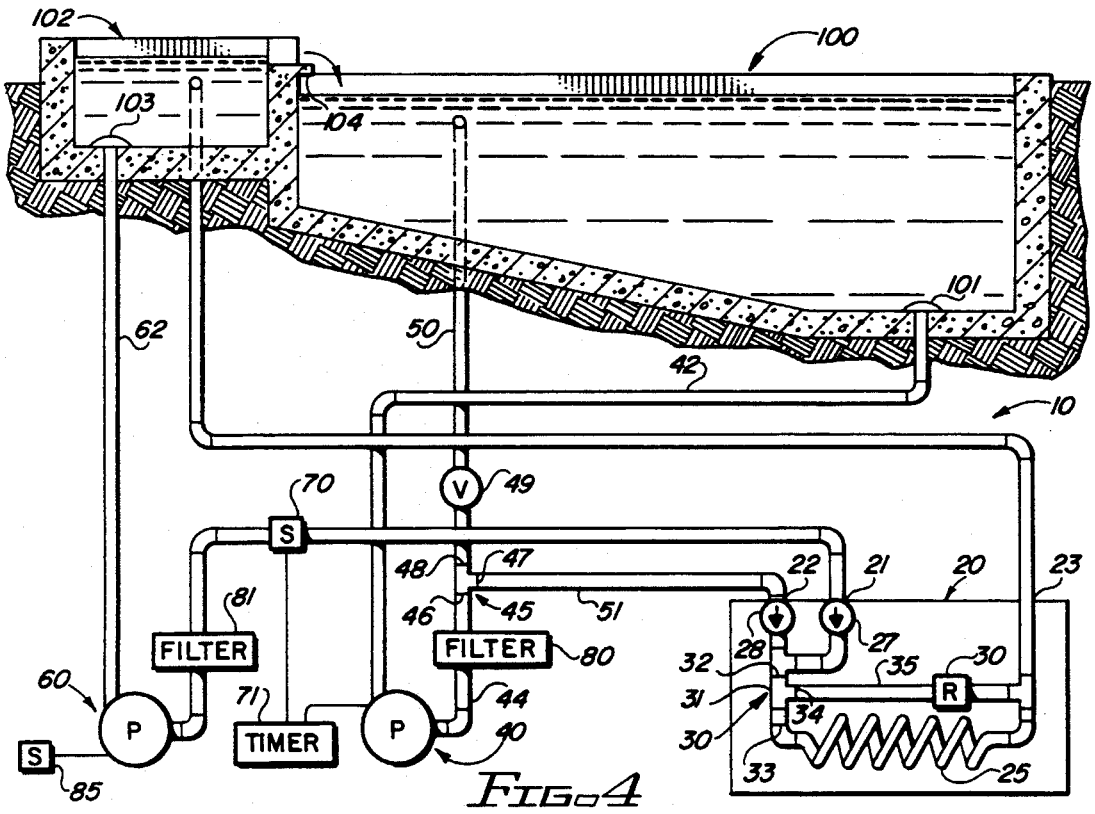
FIG. 4 is a detailed schematic of an alternative embodiment of the pool/spa heater system.

As viewed throughout the figures, the heater system 10 includes an independent pool pump 40. The pool pump 40 is adapted to draw water from the swimming pool 100 through the drain 101 of the pool 100. To facilitate this water extraction by the pool pump 40, a pool drainage conduit 42 is disposed between the pool drain 101 and the pool pump 40. The pool pump 40 is a standard-type pool pump which draws water in from the pool 100 and pushes it out for filtration or heating before returning to the pool 100. Extending from the pool pump 40 is a pool pump outlet conduit 44. In an alternative embodiment, as illustrated in FIG. 4, a pool filter 80 is included with the pool pump outlet conduit 44 such that water exiting the pool pump 40 is forced through the filter 80. The pool pump outlet conduit 44 connects the pool pump 40 with a pool/heater junction 45. The pool/heater junction 45 specifically includes a single pump inlet 46 and two outlets 47 and 48. More particularly, the outlets include a pool outlet 48 and a heater outlet 47. Further included as part of the pool/heater junction 45, and positionable either directly at the pool outlet 48 or slightly down flow therefrom, is a flow control valve 49. The flow control valve 49 which may be manually adjusted by a user as necessary is adapted to control the proportion of water which exits the pool/heater junction 45 through the pool outlet 48 as opposed to the heater outlet 47. This flow control valve 49 is adapted to be set by a user and left at a desired setting for extended periods of time without further adjustment. The valve 49 can be set at either all heater outlet 47 flow or all pool outlet 48 flow, the primary difference being that water passing through the heater outlet 47 will be able to be heated by the heater unit 20 before returning to the pool 100. Preferably, however, the valve 49 will be set somewhere between the two extremes, depending upon the desired heating rate or system requirements of the user. Extending from the pool outlet 48 of the pool/heater junction 45 is a pool inlet conduit 50. The pool inlet conduit 50 directs water exiting the pool/heater junction 45 through the pool outlet 48 back into the swimming pool 100. Connected to the heater outlet 47 of the pool/heater junction 45 is a heater inlet conduit 51. The heater inlet conduit 51 directs water exiting the pool/heater junction 45 through the heater outlet 47 into the heater unit 20. In order to direct water flow into the heater unit 20, the heater inlet conduit is connected to a pool water intake 22 of the heater unit 20.

Turning to the spa 102, a standard spa pump 60 is included. The spa pump 60 is adapted to draw water from the spa 102 through the spa drain 103. Connected between the spa pump 60 and the spa drain 103 is a spa drainage conduit 62. Water enters the spa pump 60 through the spa drainage conduit 62 and exits the spa pump 60 through a spa pump outlet conduit 64. In a preferred embodiment, the spa pump outlet conduit 64 includes a filter 81, as illustrated in FIG. 4, adapted to filter the water exiting the spa pump 60. The spa pump outlet conduit 64 is primarily adapted to direct the water from the spa pump 60 to the heater unit 20. More particularly, the spa pump outlet conduit 64 is connected with a spa water intake 21 of the heater unit 20 wherethrough spa water enters the heater unit 20.

Included within the spa pump outlet conduit 64 is a flow switch 70. The flow switch 70 is disposed within the spa pump outlet conduit 64 so as to detect, and be triggered by water flow through the spa pump outlet conduit 64. Accordingly, the flow switch 70 is engaged when the spa pump 60 is on, drawing water from the spa 102 and passing it through the spa pump outlet conduit 64 to the heater unit 20. Similarly, if the spa pump 60 is disengaged resulting in the water flow ceasing through the spa pump outlet conduit 64, the flow switch 70 is disengaged. The flow switch 70 is connected with the pool pump 40. More particularly, the flow switch 70 is specifically adapted to turn off the pool pump 40 when it is engaged, and to allow the pool pump 40 to turn on when the flow switch 70 is disengaged. The flow switch 70 is included to enable a user to shut down the pool pump 40 merely by turning on the spa pump 60. The shutting down of the pool pump 40 is desirable because if a user wants to use only the spa 102, there is no need for the pool pump 40 to be running and for pool water to be heated. The flow switch 70 functions so that the pool pump 40 will be off when the flow switch 70 is engaged, but when the flow switch 70 is disengaged, it does not function to automatically turn on the pool pump 40. When disengaged, the flow switch 70 functions to allow the pool pump 40 to turn on. Pool pump 40 functioning is dictated by the specific needs of the user or by the normal pool pump 40 functioning cycles as set by the user. Accordingly, the pool pump 40 will immediately turn on upon disengaging of the flow switch 70 only if the pool pump 40 was independently set to be on at that time anyway. To initiate this pool pump operating cycle, the heater system 10, in an alternative embodiment, includes a timer 71. The timer 71 is specifically adapted to be set by a user to indicate when the pool pump 40 is to turn on and when the pool pump 40 to turn off. The timer 71 is particularly effective to enable to the pool 100 to be filtered and heated as necessary without requiring constant inefficient working of the pool pump 40 and heater unit 20 when the pool is not in use or when additional heating or filtration of the pool 100 is not necessary. If the timer 71 is utilized with the system 10, if the flow switch 70 is engaged, the pool pump 40 will turn off even if the pool pump 40 was set to be in its operation cycle by the timer 71, or if the pool pump 40 was manually turned on by a user. When the flow switch 70 is disengaged, however, the pool pump 40 will only turn on if manually turned on by a user, if so dictated by the timer 71, or if turned on by some other control means connected to the pump 40. An additional feature included as part of an alternative embodiment is a flow switch bypass. The flow switch bypass is included as part of the flow switch 70 and is adapted to enable a user to selectively disengage the flow switch 70. The flow switch 70 can be disengaged such that during those circumstances when a user desires both the pool pump 40 and the spa pump 60 to be functioning, flow through the spa pump outlet conduit 64 will not turn off the pool pump 40. Further, if the flow switch bypass is included, the timer 71 may be adapted to automatically or selectively engage the flow switch bypass while the pool pump 40 is set to be turned on by the timer 71, thereby enabling regular pool filtration and heating cycles to continue normally.

The heater unit 20 of the heater system 10 includes primarily the spa water intake 21, the pool water intake 22, a water outlet 23, and a coiled heat exchange conduit 25 disposed therein. The coiled heat exchange conduit 25 is included within the heater unit so as to maximize the amount of time during which water passing through the heater unit 20 is exposed to heat. The heater unit 20 is preferably a conventional style swimming pool heater unit. Further included within the heater unit 20 is an internal pool/spa flow control apparatus 30. The pool/spa flow control apparatus 30 includes a heater flow junction 31 and a bypass conduit 35. More particularly, the heater flow junction 31 includes a single water inlet 32, a bypass outlet 34, and a heat exchange outlet 33. The water inlet 32 of the heater flow junction 31 is adapted to receive water entering the heater 20 through both the spa water intake 21 and the pool water intake 22. Included at the spa water intake 21 and the pool water intake 22 are a pair of one-way valves 27 and 28, respectively. The one-way valves 27 and 28 are specifically adapted to enable the water to enter the heater flow junction 31 through the water inlet 32, but only allow water to exit the heater flow junction 31 through either the heat exchange outlet 33 or the bypass outlet 34. The heat exchange outlet 33 is connected to the heat exchange conduit 25 within the heater unit 20 such that water exiting the heater flow junction 31 through the heat exchange outlet 33 will be subsequently heated before return to the pool 100 or spa 102. In addition to entering the heat exchange conduit 45, water exiting the heater flow junction 31 may enter the bypass conduit 35 through the bypass outlet 34. The bypass conduit 35 includes therein a spring loaded flow regulator valve 36. The spring loaded flow regulator valve 36 is specifically adapted to enable water to pass therethrough only upon sufficient water flow pressure build up at the flow regulator valve 36. During normal operation of the heater system 10, all water will preferably pass through the heat exchange conduit 25 for heating. In some circumstances, however, such as when water is entering the heater flow junction from both the spa water intake 21 and the pool water intake 22, water can back up at the heater flow junction 31. Because the spa water intake 21 and the pool water intake 22 each include a one-way valve 27 and 28 therein, water can only easily exit the heater flow junction 31 through the heat exchange outlet 33. To alleviate this water flow pressure build up, the bypass conduit 35 is included. Accordingly, through the use of the spring loaded flow regulator valve 36, only when there is a specific need, due to increased water flow pressure build up at the heater flow junction 31, will the flow regulator valve 36 allow water to bypass being heated. Both the bypass conduit 35 and the heat exchange conduit 25 direct water out of the heater unit 20 through the water outlet 23. Connected to this water outlet 23 is a spa water return conduit 38. The spa water return conduit 38 directs all water exiting the heater unit 20 into the spa 102. As a result, even heated pool water whose final destination is the swimming pool 100 will enter the spa 102 initially before entering the pool 100.

Figure 2:
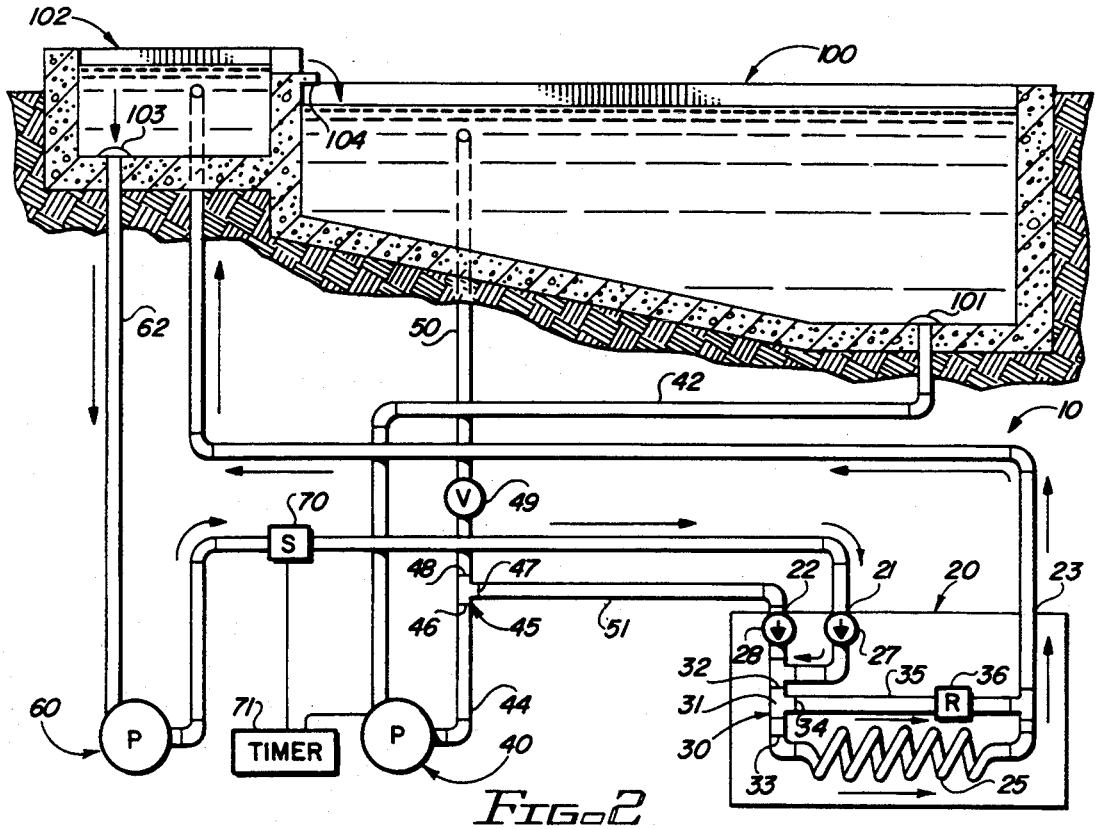
FIG. 2 is a detailed schematic of the pool/spa heater system illustrating spa only heater use.
Figure 3:
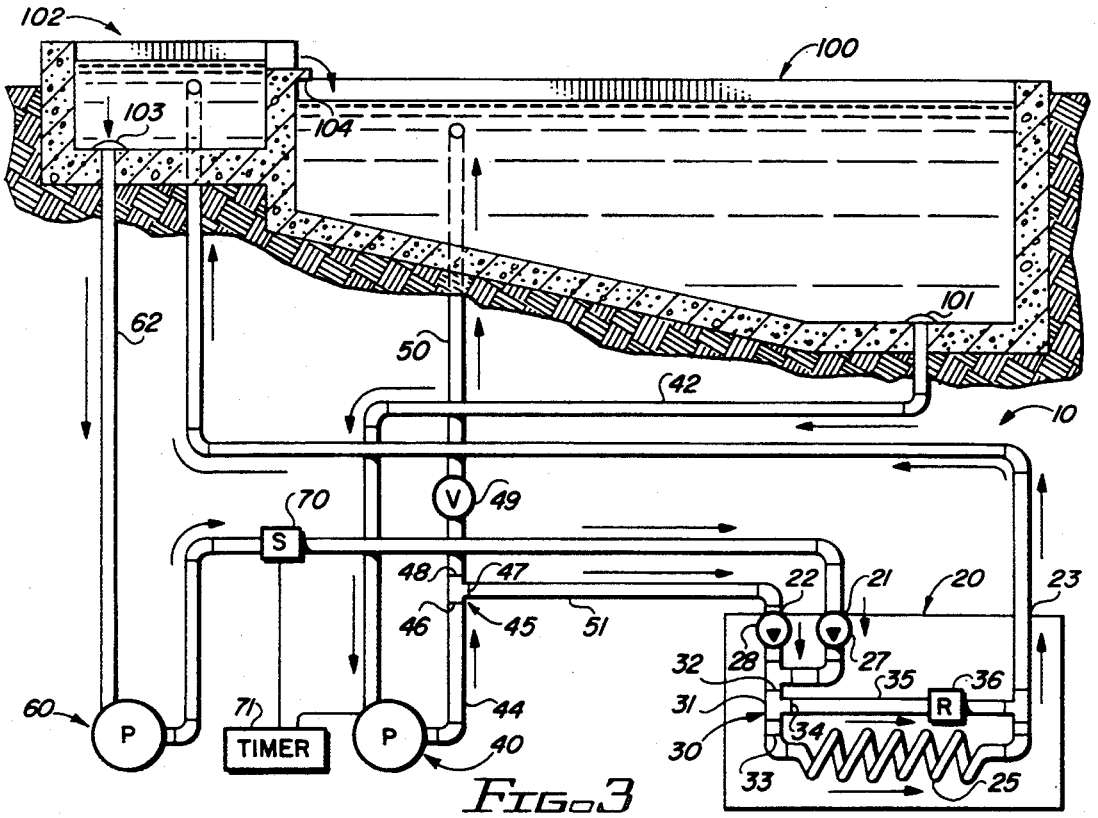
FIG. 3 is a detailed schematic of the pool/spa heater system illustrating combination pool and spa heater use.

Turning specifically to FIGS. 1–3, illustrated are the various operation combinations of the heater system 10. As illustrated in FIG. 1, when only the pool pump 40 is turned on, water exits the pool 100, passes through the pool pump 40, exits the pool pump 40, and is directed partially back into the pool 100 and partially to the heater unit 20 depending on the setting of the flow control valve 49. Upon exiting the heater unit 20 water goes into the spa 102 and not back into the pool 100. Accordingly, as the water drawn from the pool 100 is heated by the heater unit 20 and passes into the spa 102, the spa 102 becomes more and more filled. Eventually, the spa 102 becomes sufficiently filled such that the water level rises above the lip 104 resulting in an overflow of heated water into the swimming pool 100, thereby heating the swimming pool 100.

Turning to FIG. 2, when water is drawn directly from the spa 102, the pool pump 40 is turned off and the water is directed through the heater unit 20 and back into the spa 102. Because the water is drawn from the spa 102 and replaced to the spa 102, the water level of the spa will never increase so as to result in an overflow to the pool 100.

Turning to FIG. 3, if the flow switch bypass is engaged such that the flow switch 70 will not result in the shutting off of the pool pump 40, and accordingly, both the pool pump 40 and the spa pump 60 are on, water is drawn from both the swimming pool 100 and the spa 102. Water from both sources passes through the heater unit 20 and returns into the spa 102. Due to the additional water entering the spa 102 from the pool 100, the water level of the spa 102 will rise resulting in an overflow over the lip 104 to heat and refill the pool 100.

A primary benefit of the use of the heater system 10 of the present invention involves the ability to shut down the pool pump 40 simply by turning on the spa pump 60 so that the pool pump 40 is not unnecessarily operating. In order to further facilitate this function, the heater system 10 may include in an alternative embodiment remote switching means 85. The remote switching means 85 may be in the form of an air switch, a wireless remote, or a wired remote, as well as any other type of remote which will enable a user to turn on the spa pump 60 from a remote location, preferably the spa 100 itself.

The various conduits utilized as part of the present invention are preferably made of a standard PVC material, but any other similar material may be utilized.

Now that the invention has been described,

What is claimed is:

1. To be used with a pool and a spa combination, the pool and the spa each including a drain therein and being disposed with relation to one another such that excess water in the spa overflows into the pool; an auto switching swimming pool/spa heater system comprising:

a heater unit, said heater unit including a spa water intake, a pool water intake, a water outlet, and a coiled heat exchange conduit, said heat exchange conduit being structured and disposed to enable the passage of water through said heater unit for heating thereof by said heater unit, a pool pump structured and disposed to draw water from the pool, a pool drainage conduit connected between said pool pump and the pool drain such that water drawn from the pool by said pool pump passes therethrough into said pool pump, a pool/heater junction, a pool pump outlet conduit disposed between said pool pump and said pool/heater junction such that water exiting said pool pump passes therethrough into said pool/heater junction, said pool/heater junction including a pump inlet, a pool outlet, a heater outlet, and a flow control valve, said flow control valve being structured and disposed to regulate a proportion of water exiting said pool/heater junction through said pool outlet and said heater outlet, a pool inlet conduit disposed between said pool outlet of said pool/heater junction and the pool so as to direct water exiting said pool/heater junction therethrough into the pool, a heater inlet conduit disposed between said heater outlet of said pool/heater junction and said pool water intake of said heater unit so as to direct water exiting said pool/heater junction therethrough into said pool water intake of said heater unit, a spa pump structured and disposed to draw water from the spa, a spa drainage conduit connected between said spa pump and the spa drain such that water drawn from the spa by said spa pump passes therethrough into said spa pump, a spa pump outlet conduit disposed between said spa pump and said spa water intake of said heater unit such that water exiting said spa pump passes therethrough into said spa water intake of said heater unit, said spa pump outlet conduit including a flow switch therein, said flow switch being structured and disposed detect water flow through said spa pump outlet conduit and turn off said pool pump upon detection of the water flow, said spa water intake and said pool water intake of said heater unit each including a one-way valve therein such that water can only flow into said heater unit therethrough, said heater unit further including an internal pool/spa flow control apparatus therein, said flow control apparatus including a heater flow junction and a bypass conduit, said heater flow junction including a water inlet structured and disposed to receive water from said spa water intake and said pool water intake, said heater flow junction further including a bypass outlet and a heat exchange outlet, said bypass outlet being structured and disposed to direct water into said bypass conduit and said heat exchange outlet being structured and disposed to direct water into said heat exchange conduit, said bypass conduit including a spring loaded flow regulator valve therein, said flow regulator valve being structured and disposed to prevent the passage of water through said bypass conduit until a water flow pressure build up within said heater flow junction forces said flow regulator valve open, said bypass conduit and said heat exchange conduit being connected in fluid flow communication with said water outlet of said heater unit, and a spa water return conduit disposed between said water outlet of said heater unit and the spa so as to direct water exiting said heater unit into the spa.

2. A system as recited in claim 1 including a flow switch bypass structured and disposed deactivate said flow switch such that both said spa pump and said pool pump may be on simultaneously.

3. A system as recited in claim 1 including a pool filter connected to said pool pump outlet conduit so as to filter water passing through said pool pump outlet conduit.

4. A system as recited in claim 3 including a spa filter connected to said spa pump outlet conduit so as to filter water passing through said spa pump outlet conduit.

5. A system as recited in claim 2 including a pool pump timer structured and disposed to turn said pool pump on during predetermined time periods.

6. A system as recited in claim 5 wherein said pool pump timer engages said flow switch bypass during said predetermined time period when said pool pump is on.

7. A system as recited in claim 6 wherein said spa pump includes an air switch structured and disposed to enable said spa pump to be turned on and off from a remote location.

8. A system as recited in claim 6 wherein said spa pump includes a wireless remote structured and disposed to enable said spa pump to be turned on and off from a remote location.

9. A system as recited in claim 6 wherein said spa pump includes a wire remote structured and disposed to enable said spa pump to be turned on and off from a remote location.

* * * * *